US009169056B2

(12) United States Patent
Zhang

(10) Patent No.: US 9,169,056 B2
(45) Date of Patent: Oct. 27, 2015

(54) THERMALLY INSULATING MEMBER

(71) Applicant: LIAN YI DESIGN ENTERPRISE CO., LTD., Kaohsiung (TW)

(72) Inventor: Shao-Wen Zhang, Kaohsiung (TW)

(73) Assignee: Lian Yi Design Enterprise Co., Ltd., Kaohsiung (TW)

( * ) Notice: Subject to any disclaimer, the term of this patent is extended or adjusted under 35 U.S.C. 154(b) by 0 days.

(21) Appl. No.: 14/264,282

(22) Filed: Apr. 29, 2014

(65) Prior Publication Data

US 2014/0329049 A1 Nov. 6, 2014

(30) Foreign Application Priority Data

May 3, 2013 (TW) ..... 102115888 A

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01); *B65D 81/3865* (2013.01); *Y10T 428/24306* (2015.01); *Y10T 428/24314* (2015.01)

(58) Field of Classification Search
CPC ..... B65D 81/3876
USPC ..... 428/99, 136; 220/903
See application file for complete search history.

(56) References Cited

U.S. PATENT DOCUMENTS 5,667,135 A 9/1997 Schaefer
6,250,545 B1 6/2001 Mazzarolo et al.

FOREIGN PATENT DOCUMENTS

FR 2319485 A1 2/1977
TW M465360 U 11/2013

*Primary Examiner* — Alexander Thomas
(74) *Attorney, Agent, or Firm* — Alan D. Kamrath; Kamrath IP Lawfirm, P.A.

(57) ABSTRACT

A thermally insulating member includes a plane sheet having two ends spaced in a length direction and two sides spaced in a thickness direction perpendicular to the length direction. The plane sheet includes a plurality of rows of slits between the ends of the plane sheet. Each row of slits extends from one of the sides through the other side of the plane sheet. A first spacing between two adjacent rows of slits in the length direction is larger than a spacing between two adjacent slits in the same row of slits in a width direction perpendicular to the length and width directions by a second spacing. A thermally insulating strip is defined between two adjacent rows of slits. A stretchable rib is formed between two adjacent slits in the same row of slits. Each end of the plane sheet is a coupling portion free of the slits.

10 Claims, 6 Drawing Sheets

THERMALLY INSULATING MEMBER

BACKGROUND OF THE INVENTION

1. Field of the Invention

The present invention relates to a thermally insulating member and, more particularly, to a structure of a thermally insulating member providing an excellent thermally insulating effect and using less material for environmental protection as well as greatly reducing the costs for storage and transportation.

2. Description of the Related Art

Persons engaged in the fields of extremely developed industries and businesses must provide the customers with fast and satisfactory commodities or services so as to have a place in the competing markets. With regard to the restaurant business, hot foods to be consumed at certain temperatures, such as coffee, tea, boxed meals, are extremely valued markets by large businesses.

To allow easy carriage and hold of a hot food, a thermally insulating member 1 is generally provided around a packaging material of the hot food. The thermally insulating member 1 avoids the customer from scalding on the hands by the high temperature of the hot food while allowing the customer to directly hold the hot food.

With reference to FIGS. 1 and 2, the conventional thermally insulating member 1 mainly includes a wavy thermally insulating layer 11 and a surface layer 12. The thermally insulating layer 11 is bonded to the surface layer 12 by an adhesive. In use of the conventional thermally insulating member 1, it is wrapped around an outer periphery of the packaging material of the hot food. In an example of a coffee cup A0 shown in the drawing, the thermally insulating layer 11 directly abuts the outer periphery of the coffee cup A0. Since the thermally insulating layer 11 is wavy, the thermally insulating layer 11 is in discontinuous contact with the coffee cup A0 to reduce direct transmission of the high temperature from the hot food in the cup A0 to the thermally insulating member 1. Thus, the thermally insulating member 1 possesses a thermally insulating effect. After wrapping the thermally insulating member 1 around the cup A0, a customer can directly hold the thermally insulating member 1 to avoid scalding by the high temperature of the hot food in the cup A0, providing the customer with convenience while holding the hot food for eating.

Although the conventional thermally insulating member 1 can insulate the high temperature of the hot food, the thermally insulating effect of the thermally insulating member 1 is mainly provided by reducing the contact area between the thermally insulating layer 11 and the packaging material of the hot food by discontinuous contact. However, the thermally insulating layer 11 of the thermally insulating member 1 is wavy and, thus, contacts with the packaging material of the hot food by a strip-shaped area, which is still relatively large and, thus, provides a limited thermally insulating effect. Namely, the thermally insulating effect of the conventional thermally insulating member 1 should be improved.

With reference to FIG. 2, the conventional thermally insulating member 1 is in a flattened state when not in use. To avoid the loss of the thermally insulating effect of the thermally insulating layer 11, the wavy shape of the thermally insulating layer 11 must not be destroyed no matter in the storage or transportation state. Thus, the conventional thermally insulating member 1 occupies a considerable space during transportation. Particularly, the large volume of the conventional thermally insulating member 1 results in a high transportation cost and causes high costs to persons in the hot food industry using the thermally insulating member 1. As a result, persons in the hot food industry lose their competitiveness due to the increased costs.

Thus, how to provide a thermally insulating member that is low cost in use while providing an excellent thermally insulating effect is a problem to be solved by the manufacturers of the thermally insulating members.

SUMMARY OF THE INVENTION

The primary objective of the present invention is to provide a thermally insulating member to overcome the disadvantages of insufficient thermally insulating effect and high costs in use of the conventional thermally insulating member.

The present invention fulfills the above objective by providing a thermally insulating member including a plane sheet having two ends spaced from each other in a length direction and two sides spaced from each other in a thickness direction perpendicular to the length direction and extending between the ends. The plane sheet includes a plurality of rows of slits between the ends of the plane sheet. Each of the plurality of rows of slits extends from one of the two sides through the other side of the plane sheet. Two adjacent rows of slits are spaced from each other in the length direction by a first spacing. Two adjacent slits in the same row of slits are spaced from each other in a width direction perpendicular to the length and width directions by a second spacing. The first spacing is larger than the second spacing. A thermally insulating strip is defined between two adjacent rows of slits. A stretchable rib is formed between two adjacent slits in the same row of slits. Each end of the plane sheet is a coupling portion free of the slits.

The effect achieved by the above technical solution is that when the thermally insulating member is stretched outward, due to the action of the stretchable ribs of the thermally insulating member, the originally plane thermally insulating strips twist and become slanted, protrusive, and wavy. After the thermally insulating strips become wavy, substantially rhombic heat dissipating holes are defined by the thermally insulating strips and the stretchable ribs. Thus, each thermally insulating strip is in point contact with the packaging material of the hot food. Namely, the thermally insulating member can form a thermally insulating area by the plurality of rows of slits, the thermally insulating strips, and the stretchable ribs, such that the thermally insulating member possesses an excellent thermally insulating effect to increase the efficacy of the thermally insulating member. Furthermore, a wrapping and tightening effect is provided due to the physical properties of the stretchable ribs, such that the thermally insulating member can tightly abut the object to be thermally insulated with the risk of disengagement.

Another effect achieved by the above technical solution is that by forming the thermally insulating member with the plane sheet, the stacked height of plane sheets is small, effectively reducing the volume and costs for transportation of the thermally insulating members, thereby reducing the use costs of the thermally insulating member.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

DETAILED DESCRIPTION OF THE INVENTION

Figure 1:
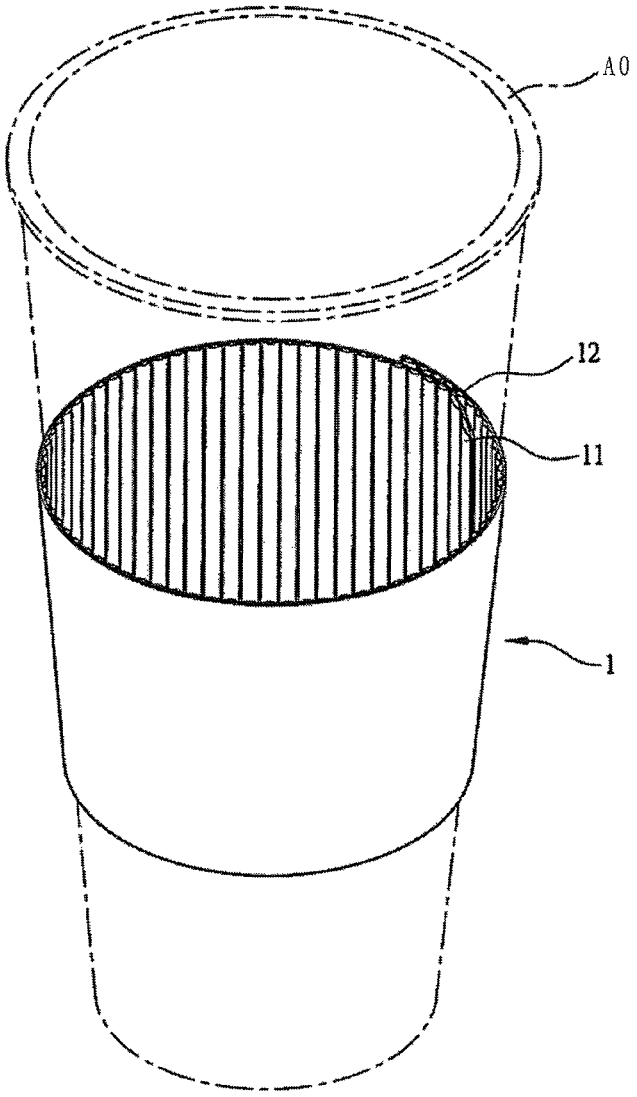
FIG. 1 PRIOR ART
FIG. 1 is a perspective view of a conventional thermally insulating member.
Figure 2:
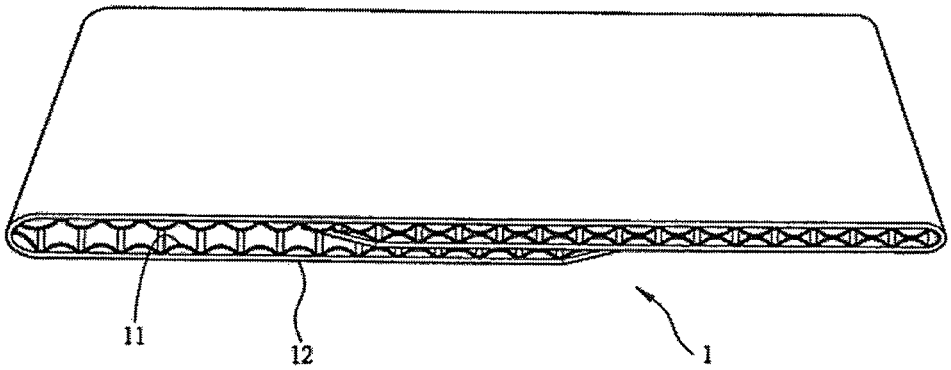
FIG. 2 PRIOR ART
FIG. 2 is a perspective view of the conventional thermally insulating member in a flattened state.
Figure 3:
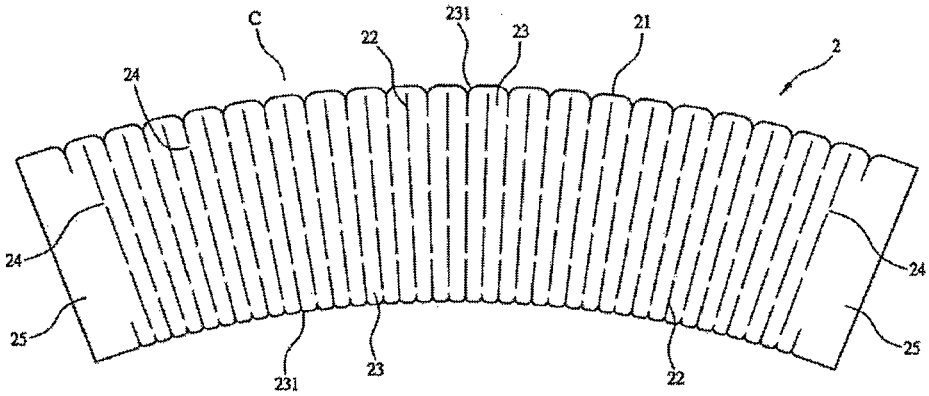
FIG. 3 is a side view illustrating a spread out state of a thermally insulating member according to the present invention.

With reference to FIG. 3, a thermally insulating member 2 according to the present invention is generally made of paper or other tough material. The thermally insulating member 2 includes a plane sheet 21 having two ends spaced from each other in a length direction and two sides spaced from each other in a thickness direction perpendicular to the length direction and extending between the two ends. The plane sheet 21 includes a plurality of rows of slits 22 between the ends of the plane sheet 21. Each row of slits 22 extends from one of the sides through the other side of the plane sheet 21. Two adjacent rows of slits 22 are spaced from each other in the length direction by a first spacing. Two adjacent slits 22 in the same row of slits 22 are spaced from each other in a width direction perpendicular to the length and width directions by a second spacing. The first spacing is larger than the second spacing. A thermally insulating strip 23 is defined between two adjacent rows of slits 22. Each thermally insulating strip 23 has upper and lower ends spaced from each other in the width direction. Each of the upper and lower ends of each thermally insulating strip 23 has at least one rounded corner 231. The upper ends of two adjacent thermally insulating strips 23 are connected to each other. Two adjacent thermally insulating strips 23 are separated from each other by a row of slits 22. A stretchable rib 24 is formed between two adjacent slits 22 in the same row of slits 22. Each end of the plane sheet 21 is a coupling portion 25 free of the slits 22. The thermally insulating member 2 includes a thermally insulating area C defined by the slits 22, the thermally insulating strips 23, and the stretchable ribs 24.

FIG. 3 shows the thermally insulating member 2 according to the present invention in a spread out state before use. The thermally insulating member 2 according to the present invention is mainly formed by the plane sheet 21 and, thus, has a limited height after stacking, effectively reducing the volume and costs of a plurality of thermally insulating members 2 during transportation.

Figure 4:
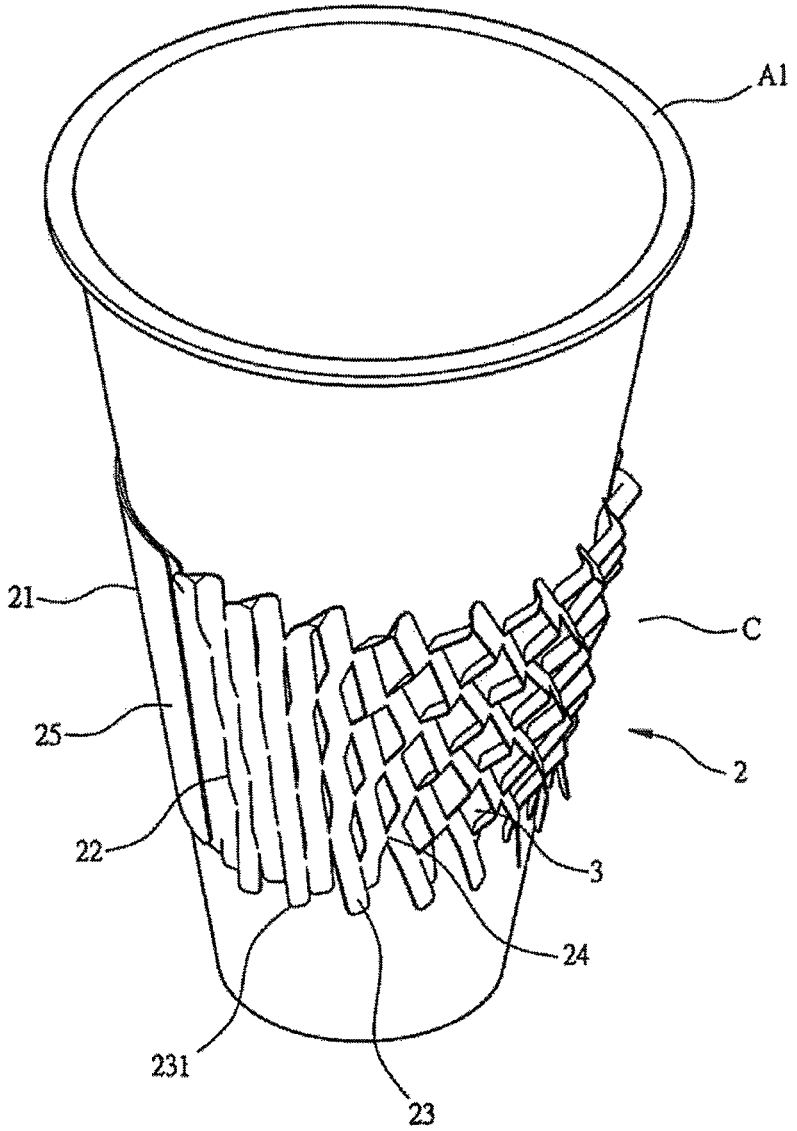
FIG. 4 is a perspective view illustrating use of the thermally insulating member according to the present invention on a cup.

In use of the thermally insulating member 2 according to the present invention, one of the coupling portions 25 is applied with an adhesive, and the other coupling portion 25 is bonded to the coupling portion 25 with the adhesive to form the thermally insulating member 2 according to the present invention in a tubular shape, as shown in FIG. 4. In use of the thermally insulating member 2 according to the present invention, the tubular thermally insulating member 2 can be directly mounted around a packaging material (such as a cup A1) receiving a hot food from below the cup A1 and then positioned around the cup A1 in an appropriate location. Since the inner diameter of the tubular thermally insulating member 2 is slightly smaller than the minimal outer diameter of the cup A1, the thermally insulating member 2 is stretched outward by the cup A1 when the thermally insulating member 2 is mounted around the cup A1 from below the cup A1 and, thus, provides a wrapping and tightening effect by the physical properties of the stretchable ribs 24. Thus, the thermally insulating member 2 can tightly abut around the object to be thermally insulated without the risk of disengagement. The originally plane thermally insulating strips 23 turn aside and become slanted, protrusive, and wavy. After the thermally insulating strips 23 become wavy, substantially rhombic heat dissipating holes 3 are defined by the thermally insulating strips 23 and the stretchable ribs 24. In this case, each thermally insulating strip 23 is in point contact with the cup A1.

As indicated by FIG. 4, by the point contact between each wavy thermally insulating strip 23 and the outer periphery of the cup A1, transmission of the high temperature of the hot food in the cup A1 to the thermally insulating member 2 can effectively be reduced. Furthermore, the heat dissipating holes 3 formed by the thermally insulating strips 23 and the stretchable ribs 24 reduce the contact area between the thermally insulating member 2 and the cup A1 while reducing the amount of heat transmitted from the hot food to the thermally insulating member 2. Furthermore, the heat dissipation effect provided by the heat dissipating holes 3 formed by the thermally insulating strips 23 and the stretchable ribs 24 further increase the thermally insulating effect of the thermally insulating member 2.

Figure 5:
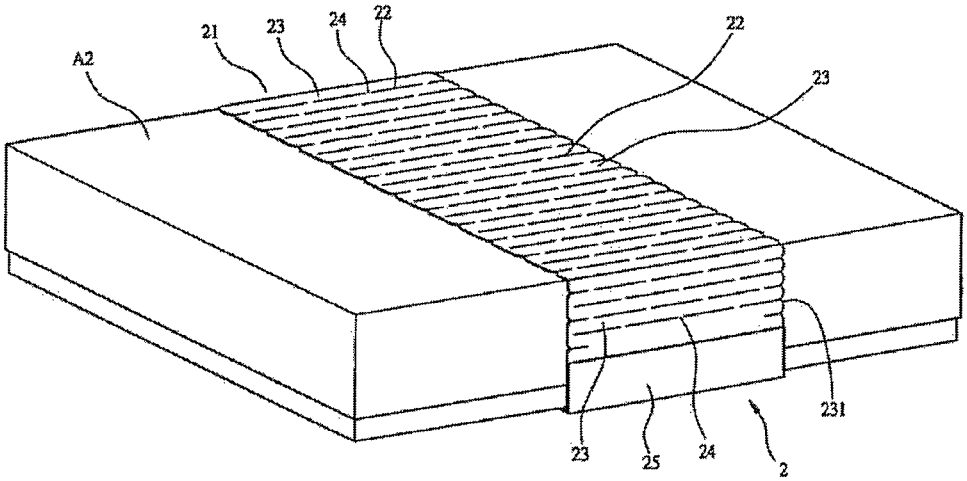
FIG. 5 is a perspective view illustrating use of the thermally insulating member according to the present invention on a meal box.
Figure 6:
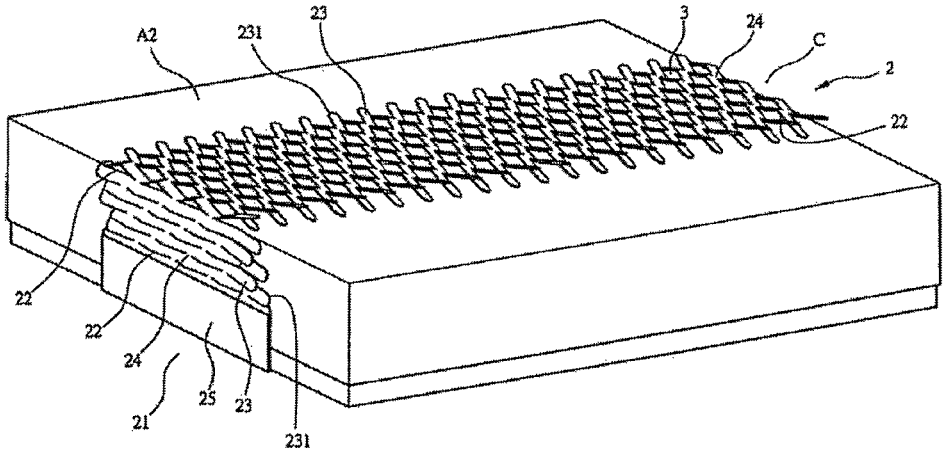
FIG. 6 is a perspective view illustrating another use of the thermally insulating member according to the present invention on the meal box.

With reference to FIGS. 5 and 6, when using the thermally insulating member 2 according to the present invention on a meal box A2 receiving a hot food, since the meal box A2 is a parallelepiped, the thermally insulating member 2 according to the present invention is firstly wrapped around the longer sides of the meal box A2 (the short axis sides of the meal box A2). The thermally insulating member 2 is not stretched and is plane. Thus, advertising figures or words can be printed on the outer side of the thermally insulating member 2 for stimulating sales. After a consumer picks the meal box, the thermally insulating member 2 can be removed from the meal box A2 and placed into a heating mechanism (such as a microwave stove) for heating purposes. After heating, the thermally insulating member 2 is wrapped around the shorter sides of the meal box A2 (the longer axis sides of the meal box A2). Thus, the thermally insulating member 2 can be stretched by the longer axis sides of the meal box A2 to turn the thermally insulating strips 23 into wavy and to form the heat dissipating holes 3 by the thermally insulating strips 23 and the stretchable ribs 24. Thus, each thermally insulating strip 23 is in point contact with the outer faces of the meal box A2 to provide a thermally insulating effect. Then, the consumer can grip the thermally insulating member 2 to hold the meal box A2.

Figure 7:
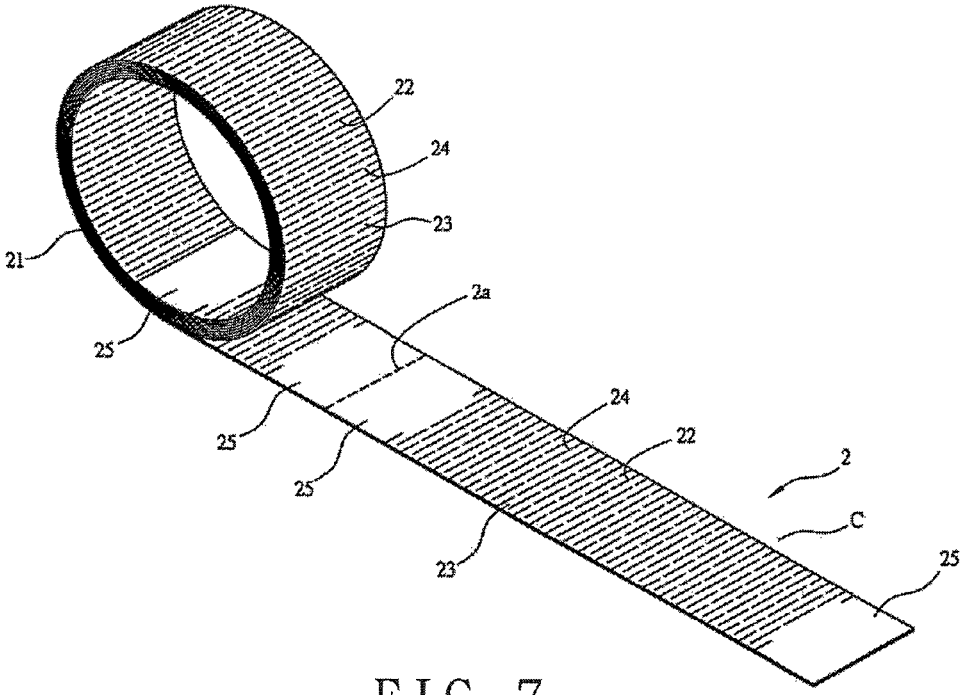
FIG. 7 is a perspective view illustrating another embodiment of the thermally insulating member according to the present invention.
Figure 8:
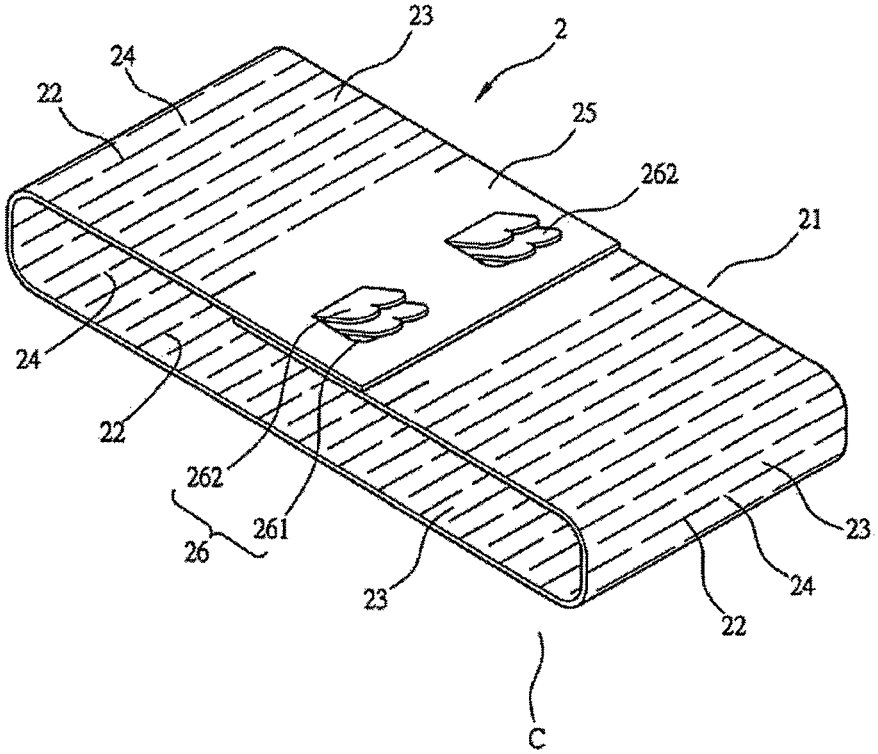
FIG. 8 is a perspective view illustrating another example of coupling potions of the thermally insulating member according to the present invention.

With reference to FIG. 7, in implementation of the thermally insulating member 2 according to the present invention, a plurality of thermally insulating members 2 is connected together with a cutting line 2*a* formed between two adjacent thermally insulating members 2. Thus, the thermally insulating members 2 can be coiled into a roll to allow easy transportation and storage of the thermally insulating members 2 according to the present invention. A user can get a thermally insulating member 2 by simply tearing along a corresponding cutting line 2*a*. The thermally insulating member 2 can be immediately used after applying an adhesive to one of the coupling portions 25 of the thermally insulating member 2.

In implementation of the thermally insulating member 2 according to the present invention, to allow easy use by consumers, a coupling mechanism 26 can directly be formed on the coupling portions 25 of the thermally insulating member 2 by cutting. The coupling mechanism 26 includes a coupling hole 261 in one of the coupling portions 25 and a coupling member 262 on the other coupling portion 25. The coupling member 262 can be detachably engaged in the coupling hole 261. Thus, the coupling portions 25 of the thermally insulating member 2 do not have to be bonded to each other by an adhesive. Instead, the coupling portions 25 of the thermally insulating member 2 can be coupled to each other by the coupling hole 261 and the coupling member 262.

Figure 9:
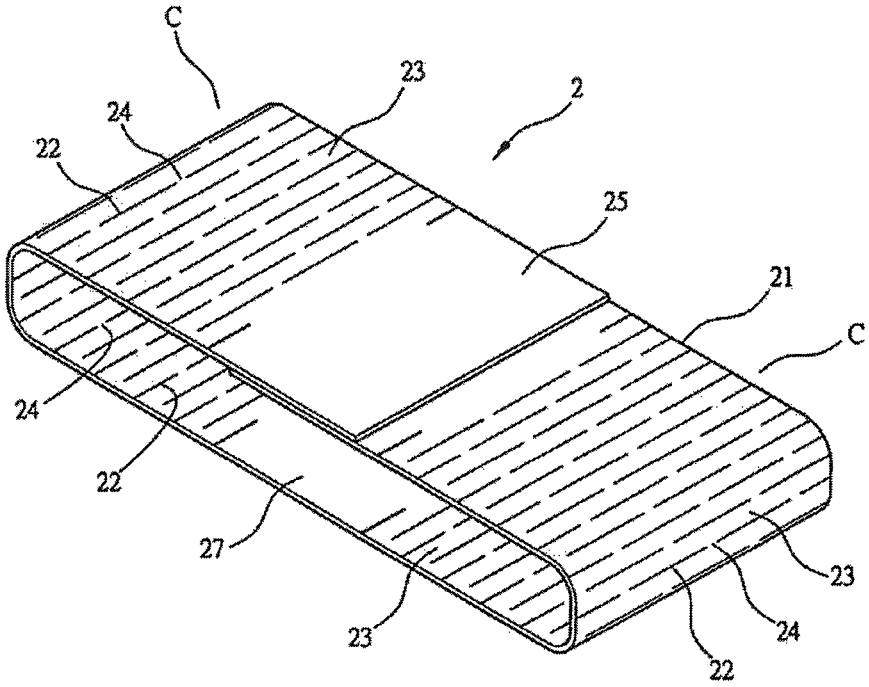
FIG. 9 is a perspective view illustrating a further embodiment of the thermally insulating member according to the present invention.

With reference to FIG. 9, in implementation of the thermally insulating member 2 according to the present invention, in addition to the coupling portions 25 on two ends of the thermally insulating member 2, one of the two sides of the plane sheet 21 facing the coupling portions 25 engaged with each other can include a separating section 27 aligned with the coupling portions 25 engaged with each other. Namely, the rows of slits 22, the thermally insulating strips 23, and the stretchable ribs 24 are located between the separating section 27 and each coupling portion 25, increasing the structural strength of the thermally insulating member 2 according to the present invention while allowing easy formation of the thermally insulating area C.

The features of the present invention are that the plurality of rows of slits 22 is formed between the ends of the plane sheet 21 (wherein each row of slits 22 extends from one of the sides through the other side of the plane sheet 21, and wherein the first spacing between two adjacent rows of slits 22 spaced from each other in the length direction is larger than a spacing between two adjacent slits 22 in the same row of slits 22 in the width direction), a thermally insulating strip 23 is defined between two adjacent rows of slits 22, a stretchable rib 24 is formed between two adjacent slits 22 in the same row of slits 22, and each end of the plane sheet 21 is a coupling portion 25 free of the slits 22. When the thermally insulating member 2 is stretched outward, due to the action of the stretchable ribs 24 of the thermally insulating member 2, the originally plane thermally insulating strips 23 twist and become slanted, protrusive, and wavy. After the thermally insulating strips 23 become wavy, substantially rhombic heat dissipating holes 3 are defined by the thermally insulating strips 23 and the stretchable ribs 24. Thus, each thermally insulating strip 23 is in point contact with the packaging material of the hot food. Namely, the thermally insulating member 2 can form the thermally insulating area C by the plurality of rows of slits 22, the thermally insulating strips 23, and the stretchable ribs 24, such that the thermally insulating member 2 possesses an excellent thermally insulating effect to increase the efficacy of the thermally insulating member 2. Furthermore, since the thermally insulating member 2 is mainly formed by the plane sheet 21, the stacked height of plane sheets 21 is small, effectively reducing the volume and costs for transportation of the thermally insulating members 2.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A thermally insulating member comprising a plane sheet including two ends spaced from each other in a length direction and two sides spaced from each other in a thickness direction perpendicular to the length direction and extending between the two ends, with the plane sheet including a plurality of rows of slits between the two ends of the plane sheet, with each of the plurality of rows of slits extending from one of the two sides through another of the two sides of the plane sheet, with two adjacent rows of slits spaced from each other in the length direction by a first spacing, with two adjacent slits in a same row of slits spaced from each other in a width direction perpendicular to the length and width directions by a second spacing, with the first spacing larger than the second spacing, with a thermally insulating strip defined between two adjacent rows of slits, with a stretchable rib formed between two adjacent slits in the same row of slits, with each of the two ends of the plane sheet being a coupling portion free of the slits.

2. The thermally insulating member as claimed in claim 1, with each thermally insulating strip having upper and lower ends spaced from each other in the width direction, with each of the upper end lower ends of each thermally insulating strip having at least one rounded corner.

3. The thermally insulating member as claimed in claim 1, with each thermally insulating strip having upper and lower ends spaced from each other in the width direction, with the upper ends of two adjacent thermally insulating strips connected to each other, and with the two adjacent thermally insulating strips separated from each other by one of the plurality of rows of slits.

4. The thermally insulating member as claimed in claim 1, with the coupling portions of the thermally insulating member including a coupling mechanism, and with the coupling portions adapted to engage with each other by the coupling mechanism.

5. The thermally insulating member as claimed in claim 4, with the coupling mechanism including a coupling hole in one of the coupling portions and a coupling member on another of the coupling portions, and with the coupling member detachably engageable in the coupling hole.

6. The thermally insulating member as claimed in claim 1, with one of the coupling portions applied with an adhesive, and with the other coupling portion adapted to be bonded to the coupling portion by the adhesive.

7. The thermally insulating member as claimed in claim 6, wherein one of the two sides of the plane sheet facing the coupling portions engaged with each other includes a separating section aligned with the coupling portions engaged with each other.

8. The thermally insulating member as claimed in claim 1, with the thermally insulating member including a thermally insulating area defined by the plurality of rows of slits, the thermally insulating strips, and the stretchable ribs.

9. The thermally insulating member as claimed in claim 8, with the thermally insulating member including a plurality of heat dissipating holes formed by the plurality of rows of slits, the thermally insulating strips, and the stretchable ribs, and with the plurality of heat dissipating holes located in the thermally insulating area.

10. The thermally insulating member as claimed in claim 9, with each of the plurality of heat dissipating holes being substantially rhombic.

* * * * *